US005836120A

United States Patent [19]

DeBower

[11] Patent Number: 5,836,120

[45] Date of Patent: Nov. 17, 1998

[54] DOOR HAVING INTEGRALLY FORMED WEEP HOLE FOR DRAINAGE

[75] Inventor: Marc M. DeBower, Pleasant Hill, Iowa

[73] Assignee: Emco Enterprises Inc., Des Moines, Iowa

[21] Appl. No.: 882,181

[22] Filed: Jun. 25, 1997

[51] Int. Cl.[6] ..... E06B 7/14

[52] U.S. Cl. ..... 52/209; 49/408

[58] Field of Search ..... 52/209, 204.52; 49/408

[56] References Cited

U.S. PATENT DOCUMENTS

| | | | |
|---|---|---|---|
| 3,878,649 | 4/1975 | Mennuto . | |
| 4,040,219 | 8/1977 | Budich | 52/209 |
| 4,154,033 | 5/1979 | Krueger et al. | 52/209 |
| 4,311,183 | 1/1982 | Herbst . | |
| 4,327,535 | 5/1982 | Governale . | |
| 4,553,361 | 11/1985 | Ralph | 52/209 |
| 4,922,674 | 5/1990 | Thorn . | |
| 4,934,098 | 6/1990 | Prouteau et al. | 49/408 X |
| 5,044,121 | 9/1991 | Harbon et al. | 52/209 X |
| 5,161,346 | 11/1992 | Olson et al. . | |

FOREIGN PATENT DOCUMENTS

| | | | |
|---|---|---|---|
| 339366 | 8/1959 | Switzerland | 52/209 |
| 2155088 | 9/1985 | United Kingdom | 52/209 |

*Primary Examiner*—Creighton Smith
*Attorney, Agent, or Firm*—Zarley, McKee, Thomte, Voorhees & Sease

[57] ABSTRACT

A door, such as a storm door, including a body having an aperture therethrough for receiving at least one window element. The body has joined but spaced apart exterior and interior panels. The exterior panel has an integrally formed weep hole therethrough which intersects the aperture and thereby puts the aperture in fluid communication with an exterior surface of the exterior panel so as to allow moisture to drain from the aperture. The weep hole can be concealed in a recessed lower portion of a molding member which is integrally formed with the exterior panel. Thus, the weep hole is concealed from normal view and the attractiveness of the door is not compromised. Additional weep holes can be added as needed for proper drainage.

20 Claims, 2 Drawing Sheets

DOOR HAVING INTEGRALLY FORMED WEEP HOLE FOR DRAINAGE

BACKGROUND OF THE INVENTION

The present invention relates to doors, more particularly, to storm doors, screen doors and the like. This invention relates to a door with an integrally formed weep hole therein.

A common objective of doors, including storm doors and the like, is to keep outside moisture from passing through the door. When the door is solid, without window openings, this is not a particularly serious problem. However, storm doors typically have a large aperture or opening therein into which window elements, such as windows and/or screens are installed. While this allows light and air to pass through the storm door, it also presents a problem in that moisture can flow downwardly along the outer surface of the window or screen and into the bottom of the aperture. This moisture will damage the door or leak into the interior of the doorway if it is not channeled or diverted to the exterior of the door.

Weep holes are commonly used in doors to prevent moisture from building up inside the door or reaching the inside of the area behind the door. However, the weep holes are relatively small and difficult to machine into the door. It would be beneficial if such machining operations could be eliminated.

Some doors have a separate decorative molding that mounts on the door and extends around the screen and window openings. Unfortunately, these decorative moldings can cover some of the better locations for weep holes. Therefore, one of the conventional ways to provide weep holes is to machine such holes through the door and molding separately in advance. The locations of the separate holes must be tightly controlled to insure that the holes will properly register with each other when the molding is attached to the door. In fact, it has been found that the small weep holes can be reasonably located by machining them through the molding after it has been mounted on the door, but it is undesirable to have a messy machining operation, such as drilling, performed during the assembly process. Thus, there is a need for a door with an integrally formed weep hole which does not require machining.

Therefore, a primary object of the present invention is the provision of a door with a weep hole which is integrally formed with the door.

A further object of the present invention is the provision of an integrally molded decorative molding extending around the outer periphery of the window or screen opening and having a weep hole integrally formed therethrough.

A further object of the present invention is the provision of an attractive door with a weep hole which is effectively hidden from normal view because it extends through a recessed lower portion of a decorative molding below the window opening.

These and other objects will be apparent from the drawings, description and claims which follow.

SUMMARY OF THE INVENTION

The present invention relates to a door, more particularly, a storm door, having a body with an aperture therethrough for receiving at least one window element. The body includes spaced apart exterior and interior panels. The exterior panel has a weep hole integrally formed therethrough. The weep hole intersects the aperture and thereby puts the aperture in fluid communication with an exterior surface of an exterior panel. This allows moisture to drain from the aperture.

The weep hole can be integrally molded in a molding member integrally formed on the exterior panel. The weep hole extends through a recessed lower portion of the molding member while the rest of the molding member rises outwardly above the main surface of the exterior panel.

A liner can be provided in the lower portion of the aperture for guiding window elements and facilitating the draining of moisture to the weep hole.

DETAILED DESCRIPTION OF THE PREFERRED EMBODIMENT

Figure 1:
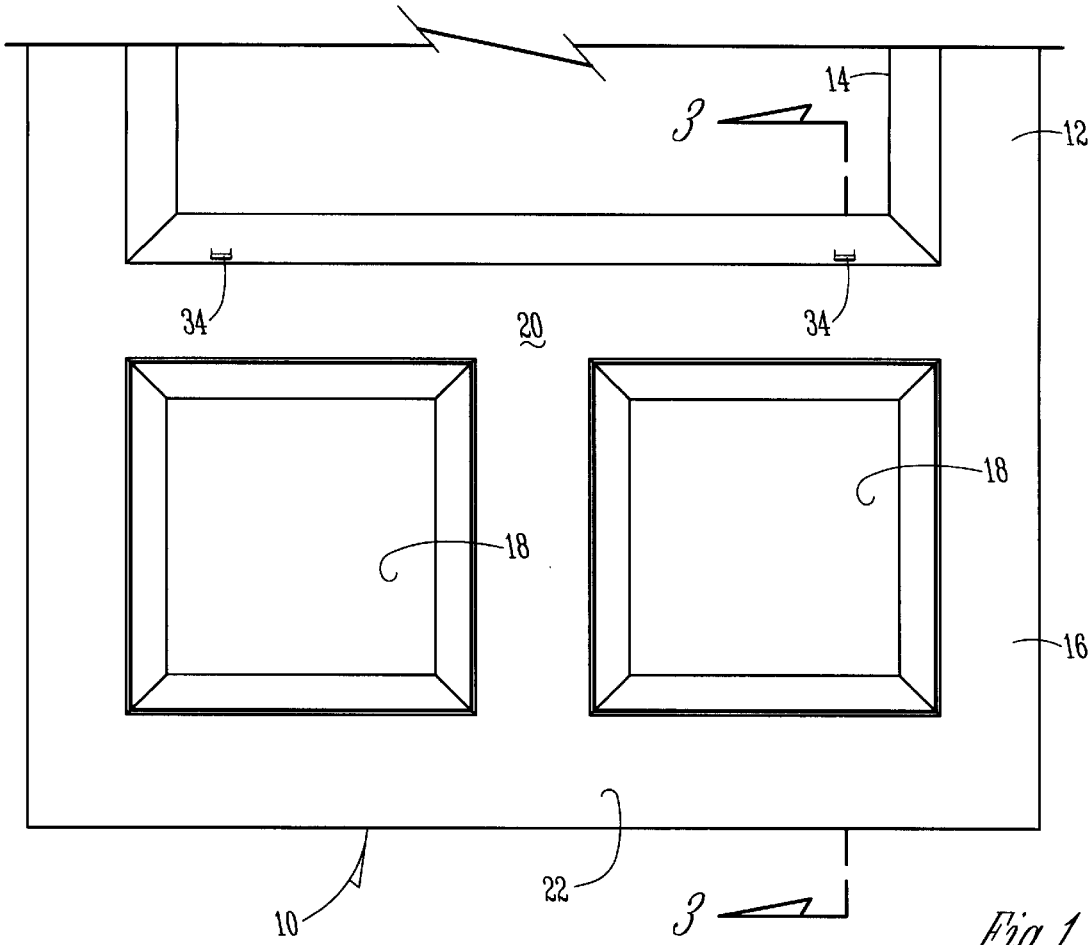
FIG. 1 is a front elevation view of the lower portion of the door of this invention.

In the figures and the description which follows, the door of the present invention is generally denoted by the reference numeral 10. In FIG. 1, the door or storm door 10 has a body 12 with an aperture or opening 14 therethrough. A decorative kick panel 16 extends below the opening 14. One or more decorative surface contours, such as indentations 18, can be provided on the kick panel 16. The indentations 18 can be included on the main exterior face 20 of the door 10, an interior face of the door 10, or both.

The door 10 includes an extruded or molded exterior panel 22 joined together with a spaced apart extruded or molded interior panel 24. The exterior panel 22 comprises the generally planar main exterior face 20 previously mentioned and a decorative molding member 26 integrally formed thereon. At least a portion of the decorative molding member 26 rises outwardly above the exterior face 20 and protrudes, in a generally vertical plane, into and around the perimeter of the opening 14.

Figure 2:
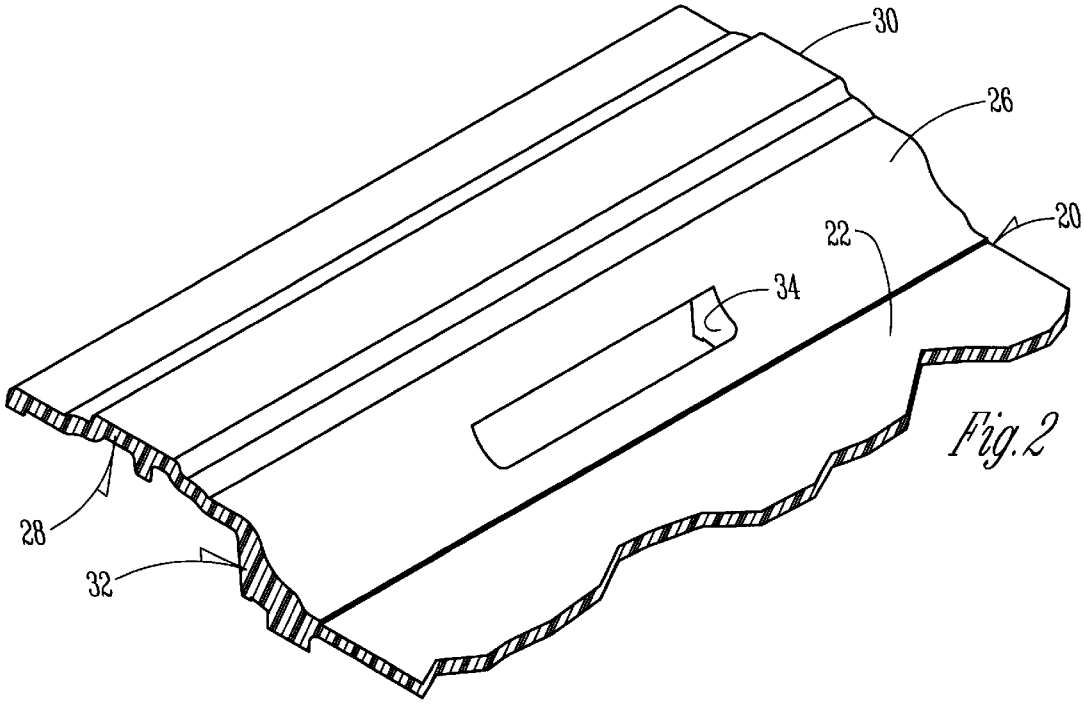
FIG. 2 is an enlarged perspective view of the integral molding on the door of FIG. 1 and shows the weep hole in greater detail.
Figure 3:
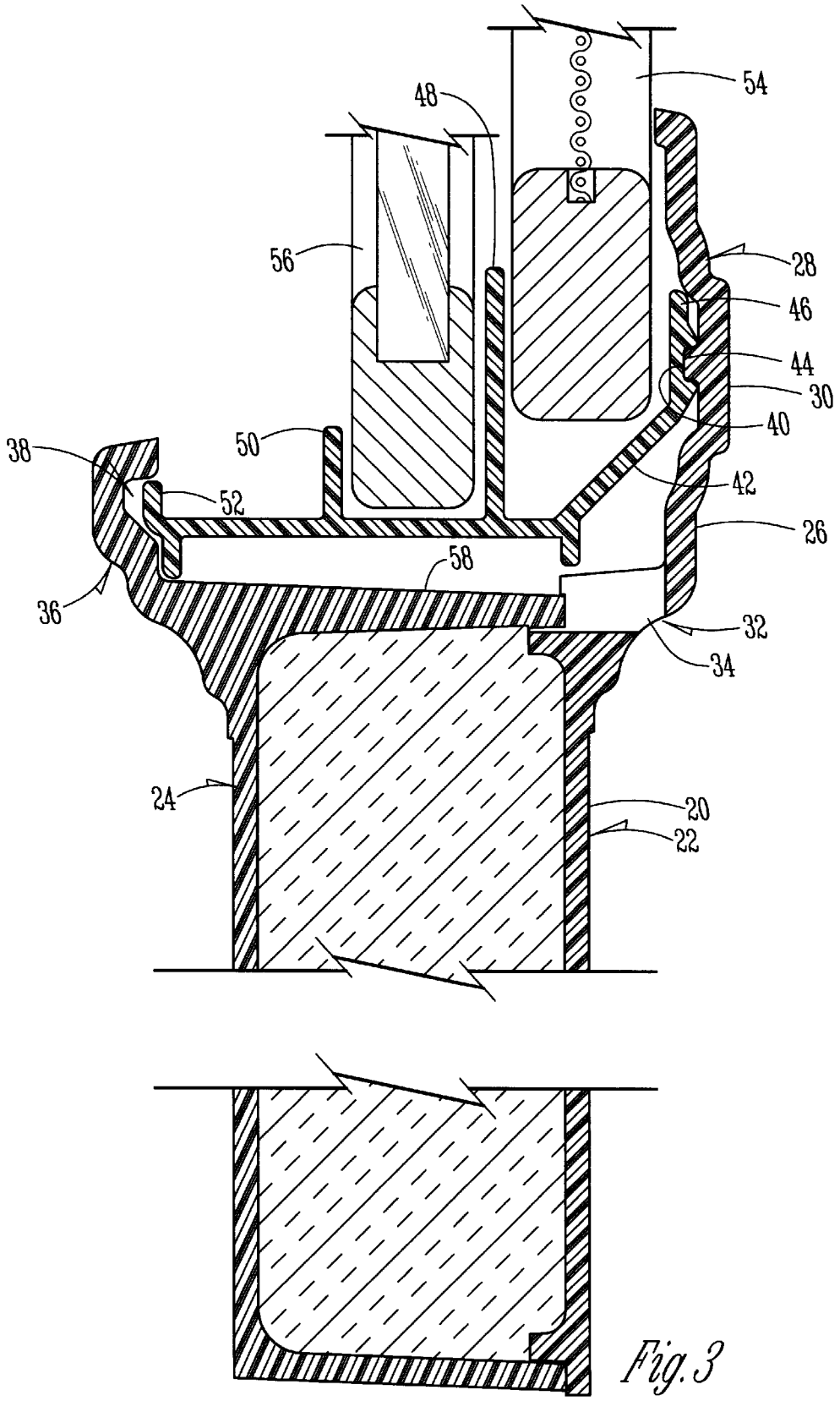
FIG. 3 is a cross-sectional view taken along line 3—3 in FIG. 1 and shows a liner inserted in the window opening adjacent the weep hole.

The molding member 26 is integrally molded, extruded or otherwise formed at the same time as the exterior panel 22. Thus, the molding member 26 and the exterior face 20 of the panel 22 are one integrated piece, as best seen in FIGS. 2 and 3. No separate fasteners or fastening operations are required.

FIG. 2 shows the molding member 26 in greater detail. The molding member 26 has a raised upper portion 28, whereupon a horizontal decorative strip 30 is formed, and a recessed lower portion 32 through which a weep hole 34 extends. Preferably the weep hole 34 is horizontally elongated to provide a better flow path. The generally rectangular shape shown in the figures has been found to work well. The weep hole 34 is integrally formed, molded or extruded with the molding member 26 and the exterior panel 22. This eliminates the machining operation(s) conventionally required to provide the weep hole 34. As shown in FIG. 1, the preferred embodiment provides two identical weep holes 34, one inwardly adjacent from each of the lower corners of the aperture 14. FIG. 3 shows that the weep hole 34 extends into fluid communication with the aperture 14.

The molding member 26 constitutes an exterior window element retention flange. The interior panel 24 has an interior window element retention flange 36 which is spaced apart from the exterior flange or molding member 26 and extends perimetrically inward around the aperture 14. The interior flange has a generally horizontal groove 38 formed on the inward surface of the flange 36. A generally horizontal rail 40 protrudes from the inward surface of the exterior flange or molding member 26. The rail 40 is shown to be located on the inward side of the decorative strip 30, however, other locations along the inward surface of the molding member 26 would suffice.

An elongated liner 42 is interposed between the exterior and interior retention flanges 36, 26. The liner 42 can be wedged between the flanges 26, 36. The liner 42 includes a horizontal slot 44 which is adapted to snap onto the rail 40 to secure the liner 42 to the molding member 26. The liner 42 has a plurality of horizontal elongated, spaced apart partitions 46, 48, 50 and 52 which are adapted to guide window elements, such as a screen 54 and/or a window 56. Those skilled in the art will appreciate that other combinations of window elements are possible without detracting from this invention.

The liner 42 is open at either end and its length is such that a gap is left at either end of the lower portion of the aperture 14. The liner 42 slopes downwardly from the middle to the ends so that any moisture caught in the channels between the partitions 46–52 of the liner 42 is drained toward the weep holes 34. The partitions 48, 50 and 52 are arranged by height in descending order from the exterior of the door toward the interior of the door. Thus, any moisture caught in the channels will tend to overflow into the inwardly adjacent channel until the moisture overflows partition 52. The inner panel 24 of the door has a cross member 58 which extends below the aperture 14. The cross member 58 is sloped downwardly toward the weep hole 34 in the exterior panel 22. As a result, an extremely effective drainage system is provided by this invention.

Assembling the door of this invention is a quick and easy task which does not involve machining of the exterior panel 22 or the molding member 26. The exterior and interior panels 22, 24 come preformed, molded, or extruded in the form shown in the drawings. The molding member 26 is integrally formed with the exterior panel 22. Furthermore, the weep hole 34 is integrally formed through the exterior panel 22 on the lower portion of the molding member 26. The exterior and interior panels 22, 24 are positioned in spaced apart relation as shown in FIG. 3. Then, according to a conventional process, adhesive foam is blown into the space between the panels 22, 24 through holes in the panels. Generally, inlet and exhaust openings (not shown) are provided through the panels 22, 24 in inconspicuous locations. The adhesive foam 60 fills the void between the panels 22, 24 and adheres them together. Note that the panels 22, 24 have interlocking structures to assist with the alignment and joining processes.

Following the joining of the panels 22, 24, the liner 42 is installed in the lower portion of the aperture 14, as shown in FIG. 3. Once the liner 42 is inserted between the inner flange 36 and the molding member 26, the slot 44 on the liner 42 is snapped onto the rail 40. Then, selected window elements, such as screen 54 and window 56, can be installed in the aperture 14 and may rest between the partitions 46, 48, 50 and 52 of the liner 42.

In operation, outside moisture may penetrate the screen 54 and be deposited on the window 56. Such moisture will fall by gravity into the channel between the partitions 48, 50. Some of the moisture will drain out the ends of the liner 42 and through the weep holes 34. Any moisture which does not drain out the ends of the liner will drain out the front of the liner, past partition 52 and down the sloped cross member 58 of the interior panel 24. In either case, the moisture is drained to the weep hole 34 and expelled outside the door 10. Thus, outside moisture is prevented from reaching the interior space behind the door 10.

Because of their positions, the weep holes of this invention are effectively hidden from normal view because they extend through a recessed lower portion 32 of the decorative molding 26. The attractiveness of the exterior panel is not compromised.

Therefore, it can be seen that the present invention at least accomplishes its stated objectives.

The door 10 is preferably one inch thick, however, the invention is also applicable to doors of other thicknesses. It is contemplated that a different number of partitions can protrude from the liner 42 to provide channels for a different number of window elements.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A door, comprising:

a body having an aperture therethrough for receiving at least one window element;

the body including substantially parallel and spaced apart exterior and interior panels joined together to define the aperture;

the exterior panel having an integrally formed weep hole extending therethrough which intersects the aperture and thereby puts the aperture in fluid communication with a generally vertical exterior surface of the exterior panel so as to allow moisture to drain from the aperture.

2. The door of claim 1 wherein the weep hole is integrally molded in the exterior panel.

3. The door of claim 1 wherein the exterior panel includes a generally vertical molding member integrally formed therewith, the molding member has a lower portion extending adjacent to a lower portion of the aperture, and the weep hole extends through the molding member extending adjacent to the lower portion of the aperture.

4. The door of claim 3 wherein the exterior panel has a generally planar main surface and a portion of the molding member is raised outwardly above the exterior surface.

5. The door of claim 4 wherein the molding member has a lower portion recessed from the raised portion, the weep hole extending through the lower recessed portion of the molding member, whereby the raised portion of the molding member effectively hides the weep hole when the molding is viewed from above.

6. The door of claim 3 wherein the molding member protrudes into and extends perimetrically around the aperture.

7. The door of claim 6 wherein the molding member constitutes an exterior window element retention flange and the interior panel has an interior window element retention flange protruding into and extending perimetrically around the aperture.

8. The storm door of claim 1 wherein the at least one window element includes a window.

9. The storm door of claim 1 wherein the at least one window element includes a mesh screen.

10. The door of claim 1 wherein the door is a storm door and one of the window elements is movable within the aperture.

11. The door of claim 3 wherein the molding member is integrally extruded with the exterior panel.

12. The door of claim 1 wherein the weep hole extends through the exterior panel at an acute angle with respect to the exterior panel.

13. A self-draining door, comprising:

a body member having an aperture therein for receiving at least one window element;

the body member being formed by an exterior panel and an interior panel spaced apart from the exterior panel and joined thereto along an inner periphery surrounding the aperture;

the exterior panel having a weep hole integrally formed therethrough for placing the aperture in fluid communication with a generally vertical exterior surface of the exterior panel and draining the aperture.

14. A storm door, comprising:

a body having an aperture therethrough for receiving at least one window element, the aperture having a top and a bottom;

the body including spaced apart exterior and interior panels;

the exterior panel comprising an integrally formed weep hole therethrough which intersects the aperture and thereby puts the aperture in fluid communication with a generally vertical exterior surface of the exterior panel so as to allow moisture to drain from the aperture;

the exterior panel including a generally vertical molding member integrally formed therewith, the molding member protruding into and extending perimetrically around the aperture, and the weep hole extending through the molding member and into the bottom of the aperture.

15. A door, comprising:

a body having an aperture therethrough for receiving at least one window element;

the body including spaced apart exterior and interior panels;

the exterior panel comprising an integrally formed weep hole therethrough which intersects the aperture and thereby puts the aperture in fluid communication with an exterior surface of the exterior panel so as to allow moisture to drain from the aperture;

a molding member protruding into and extending around the aperture, the molding member constituting an exterior window element retention flange and the interior panel having an interior window element retention flange protruding into and extending perimetrically around the aperture; and a liner for receiving the at least one window element and being interposed between the exterior and interior window retention flanges.

16. The door of claim 15 wherein the liner for receiving at least one window element is wedged between the exterior and interior window element retention flanges.

17. The door of claim 9 wherein the molding member has an inner surface which has an elongated generally horizontal rail extending therefrom and the liner has a generally horizontal slot adapted to snap onto the rail to secure the liner to the molding member.

18. The door of claim 15 wherein the interior window element retention flange includes an inwardly directed surface that has an elongated generally horizontal groove therein adapted to retain a portion of the liner.

19. The door of claim 15 wherein the liner has a plurality of horizontally elongated spaced apart partitions for guiding window elements therebetween.

20. A door, comprising:

a body having an aperture therethrough for receiving at least one window element;

the body including spaced apart exterior and interior panels;

the exterior panel comprising an integrally formed weep hole therethrough which intersects the aperture and thereby puts the aperture in fluid communication with an exterior surface of the exterior panel so as to allow moisture to drain from the aperture;

wherein the interior and exterior panels are permanently joined together by an adhesive material interposed between the panels, the panels also being joined together by the adhesive material at an outer peripheral edge of the door and at an inner peripheral edge surrounding the aperture.

* * * * *